US005644278A

United States Patent [19]

Takezawa

[11] Patent Number: 5,644,278

[45] Date of Patent: Jul. 1, 1997

[54] LIQUID COOLING TYPE CATHODE-RAY TUBE

[75] Inventor: Hiroyuki Takezawa, Kanagawa, Japan

[73] Assignee: Sony Corporation, Tokyo, Japan

[21] Appl. No.: 631,783

[22] Filed: Apr. 12, 1996

[30] Foreign Application Priority Data

Apr. 13, 1995 [JP] Japan ..... 7-088290

[51] Int. Cl.[6] ..... H01F 7/00; H01J 7/26; H01J 29/80

[52] U.S. Cl. ..... 335/210; 313/36; 313/406

[58] Field of Search ..... 335/210, 213, 335/214; 313/36, 402, 406, 440

[56] References Cited

U.S. PATENT DOCUMENTS

| | | | |
|---|---|---|---|
| 4,257,667 | 3/1981 | Iantorno | 439/844 |
| 4,634,918 | 1/1987 | Kato et al. | 313/36 |
| 4,829,212 | 5/1989 | Serio et al. | 313/406 |
| 4,950,943 | 8/1990 | Ito | 313/406 |
| 5,347,367 | 9/1994 | Swank et al. | 335/210 |
| 5,430,352 | 7/1995 | Yamaguchi | 335/210 |

*Primary Examiner*—Stuart N. Hecker

*Attorney, Agent, or Firm*—Hill, Steadman & Simpson

[57] ABSTRACT

In a liquid cooling type cathode-ray tube including a cathode-ray tube assembly (1), a coupler (3) provided in the front surface side of the cathode-ray tube assembly (1) to seal a coolant (9), and fixing members (6) for fixing the coupler (3) to the cathode-ray tube assembly (1), engagement pins (14A), (14B) are fitted into and fixed into a pair of as cast holes (11A), (11B) defined on the coupler (3) or the fixing members (6), and an earth wire (16) which directly closely contacts with an outer conductive film (2) to apply an earth potential to the outer conductive film (2) is extended between a pair of engagement pins (14A) and (14B) through a spring (17). Thus, the earth potential can be applied to the outer conductive film (2) of the liquid cooling type cathode-ray tube with a high reliability and a satisfactory working property.

10 Claims, 3 Drawing Sheets

LIQUID COOLING TYPE CATHODE-RAY TUBE

FIELD OF THE INVENTION

The present invention relates to a liquid cooling type cathode-ray tube for use with a projection type image display device (often referred to as "projection television").

BACKGROUND OF THE INVENTION

U.S. Pat. No. 4,634,918 describes an example of a liquid cooling type cathode-ray tube which comprises a cathode-ray tube assembly, a metal die cast coupler with a projection lens held thereon, the coupler being attached to the front surface of the cathode-ray tube assembly, and a coolant sealed in a liquid tight space formed by the front surface of the cathode-ray tube assembly, the coupler and the projection lens. In such cathode-ray tube, an earth potential is applied to an outer conductive film (e.g., carbon film) coated on the outer side surface of a funnel. The earth potential is generally applied to the outer conductive film by conventional methods using an earth spring or an earth wire.

Further, there is proposed a method of using an earth wire in the liquid cooling type cathode-ray tube in which the coupler is provided with protruded portions and an earth wire that comes in contact with the outer conductive film is extended between the protrusion portions. However, if the protruded portions are round, then the earth wire is easily detached from the protruded portions. If the protruded portions have stepped portions in order to prevent the earth wire from being detached therefrom, then a metal mold for die-casting such protruded portions become complicated in structure, and the protruded portions become difficult to be molded, and expensive.

Furthermore, there is proposed a method in which a coupler or the like has a threaded portion and an earth wire which comes in contact with an outer conductive film is fixed by screws. This proposed method has the increased number of processes such as threading or screwing, which results in a poor working property. In addition, a liquid cooling type cathode-ray tube become expensive due to a processing cost of threading and costs of screws.

SUMMARY OF THE INVENTION

In view of the aforesaid aspect, it is an object of the present invention to provide a liquid cooling type cathode-ray tube in which an earth potential can be applied to an outer conductive film with a high reliability and a satisfactory working property.

In a liquid cooling type cathode ray tube according to the present invention, a pair of engagement pins are fitted into and fixed into a pair of holes defined in a coupler or fixing members for fixing a cathode-ray tube assembly and the coupler with a pressure. An earth wire which directly closely contacts with the outer conductive film to apply an earth potential to the outer conductive film is extended between a pair of engagement pins through a spring.

A pair of holes are bored at the same time the coupler or the fixing members are molded. When the engagement pins are fitted into and fixed into the holes with a pressure, the engagement pins can be implanted with a high reliability and a satisfactory working property. The earth wire extended between the engagement pins is extended through the spring and closely contacted with the outer conductive film of the cathode-ray tube assembly, and the earth potential is applied to the outer conductive film through the above portion in which the earth wire is closed contacted with the outer conductive film.

According to an aspect of the present invention, there is provided a liquid cooling type cathode-ray tube including a cathode-ray tube assembly, a coupler provided on a front surface of the cathode-ray tube assembly to seal a coolant and fixing members for fixing the coupler to the cathode-ray tube assembly. This liquid cooling type cathode-ray tube is comprised of a pair of holes defined on the coupler or the fixing members, a pair of engagement pins fixed into the pair of holes with a pressure, and an earth wire which directly closely contacts with an outer conductive film to apply an earth potential to the outer conductive film, the earth wire being extended between the pair of engagement pins through a spring.

According to another aspect of the present invention, there is provided a method of fabricating a liquid cooling type cathode-ray tube including a cathode-ray tube assembly, a coupler provided on a front surface of the cathode-ray tube assembly to seal a coolant and fixing members for fixing the coupler to the cathode-ray tube assembly. This method of fabricating a liquid cooling type cathode-ray tube is comprised of the steps of defining a pair of holes on the coupler or the fixing members, fixing a pair of engagement pins into the pair of holes with a pressure, and extending an earth wire, which directly closely contacts with an outer conductive film to apply an earth potential to the outer conductive film, between the pair of engagement pins through a spring.

DETAILED DESCRIPTION OF THE PREFERRED EMBODIMENT

A liquid cooling type cathode-ray tube according to the present invention will hereinafter be described with reference to the accompanying drawings.

Figure 1:
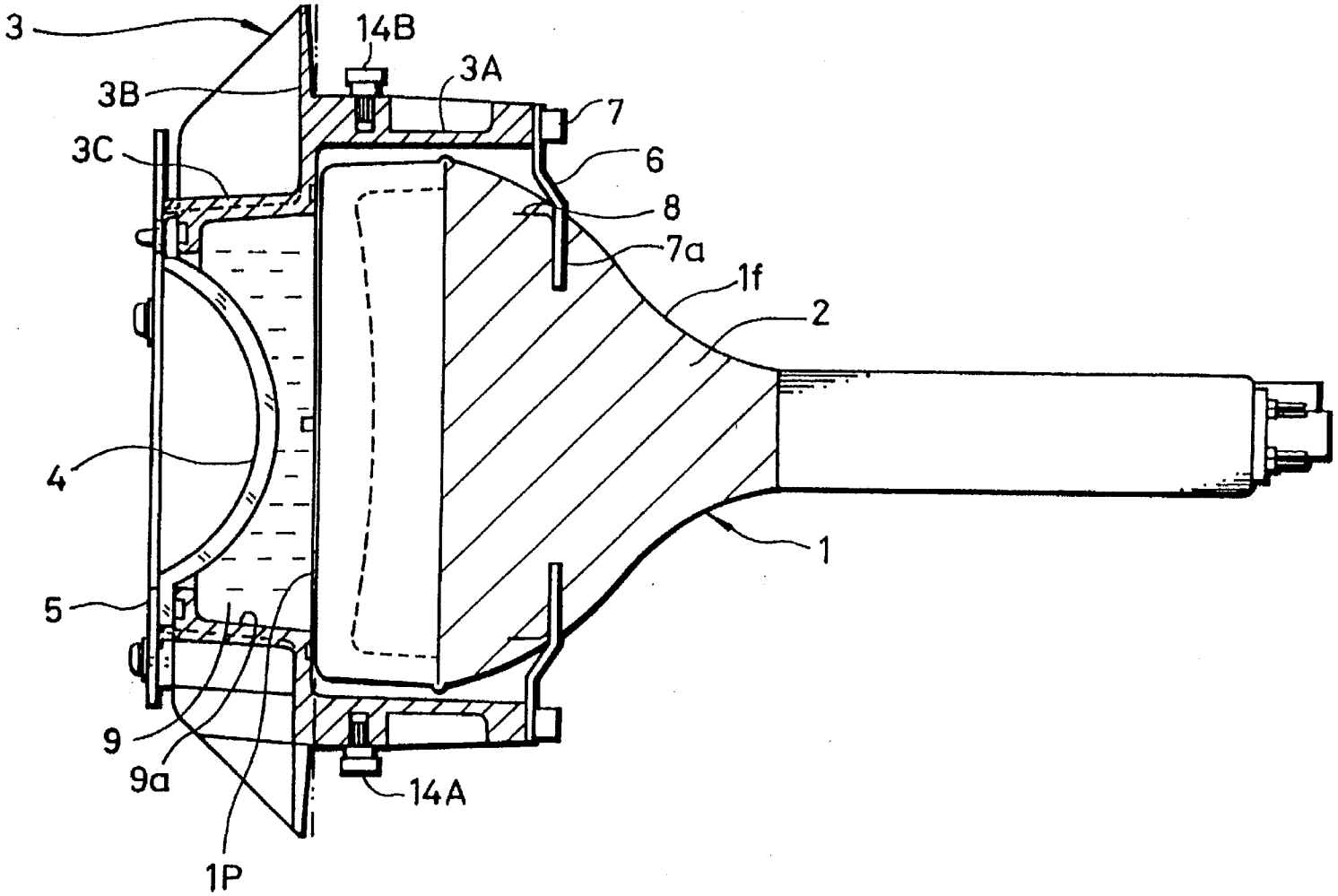
FIG. 1 is a side view, partly in cross-sectional form, of a liquid cooling type cathode-ray tube according to the present invention.
Figure 2:
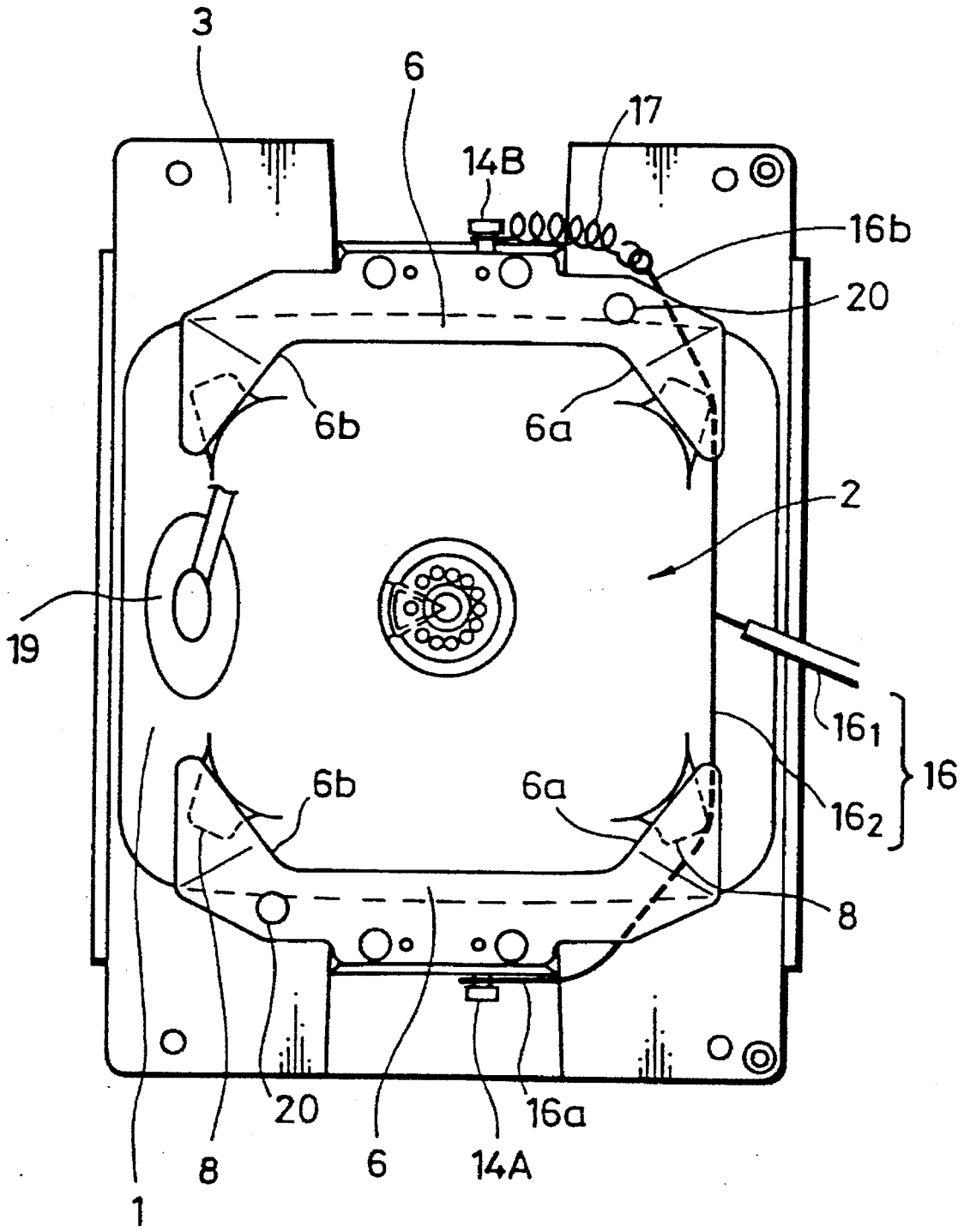
FIG. 2 is a rear view illustrative of the liquid cooling type cathode-ray tube according to the present invention.

FIG. 1 is a side view, partly in cross-sectional form, illustrative of a liquid cooling type cathode-ray tube according to the present invention, and FIG. 2 is a rear view thereof.

The liquid cooling type cathode-ray tube according to this invention includes a cathode-ray tube assembly which is generally depicted at reference numeral 1. The cathode-ray tube assembly 1 has a funnel if with an outer conductive film, e.g., an outer carbon film 2 coated on its outer side surface. In FIG. 2, reference numeral 19 denotes an anode button. The cathode-ray tube assembly 1 has a coupler 3 attached to its front panel, and the coupler 3 is served to seal a coolant, and served as a holder for holding a projection lens.

The coupler 3 is molded of die-casting of aluminum (Al), for example. The coupler 3 comprises a supporting portion 3A provided in opposing relation to the outer side surface extended from a panel 1P to the funnel 1f of the cathode-ray tube assembly 1, a flange portion 3B provided in contact with the front surface of the panel 1P so as to serve as a heat radiator, and a frame-shaped portion 3C extended from the inner marginal edge of the flange portion 3B so as to seal a coolant.

The frame-shaped portion 3C has a first projection lens 4 comprising a projection lens system attached thereto by a support plate 5 in opposing relation to the panel 1P.

The coupler 3 is fixed to the cathode-ray tube assembly 1 by a pair of fixing members 6, 6 each of which is shaped as substantially U-letter as seen from the top. The fixing members 6, 6 are symmetrically disposed on the upper and lower portions of the cathode-ray tube assembly 1. The fixing members 6, 6 are fixed to the rear end of the coupler 3 by some suitable means, such as screws 7 under the condition that free ends **6*a*, 6*b* thereof are contacted with mount portions 8 integrally formed on the funnel 1f of the cathode-ray tube assembly 1** through packing (not shown).

The cathode-ray tube assembly 1 is held by the fixing members 6 contacting with the mount portions 8 and the flange portion 3B of the coupler 3, whereby the coupler 3 is fixed to the cathode-ray tube assembly 1.

The panel 1P, the frame-shaped portion 3C of the coupler 3 and the first projection lens 4 form a space **9*a* extended thereamong, and a coolant 9 is sealed into this space 9*a***.

Figure 3A:
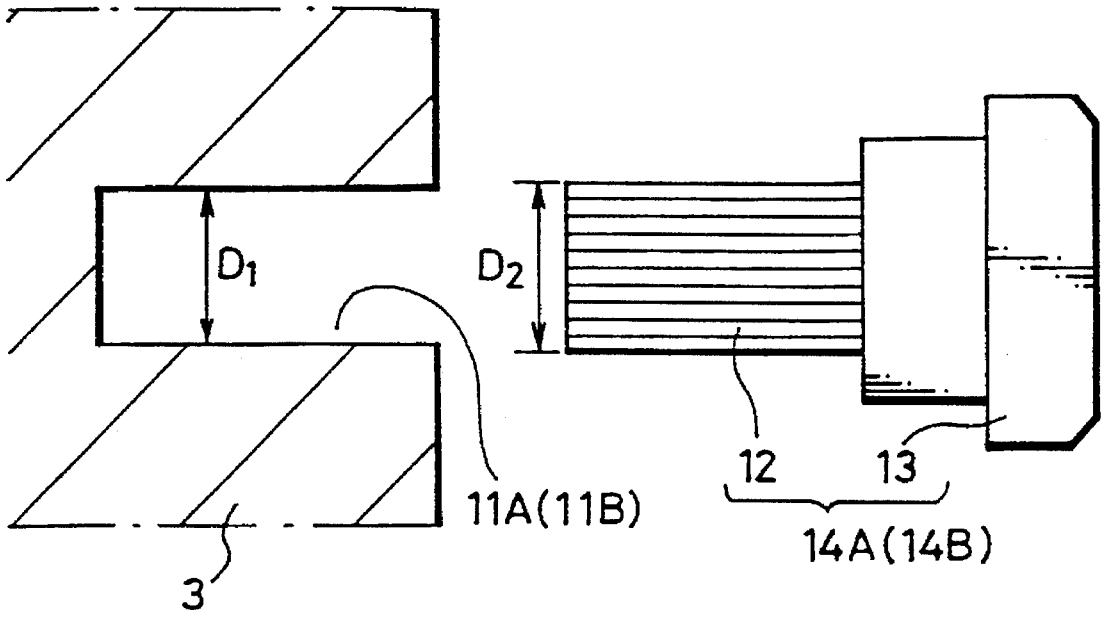
FIG. 3A is a diagram used to explain the state in which an engagement pin is not yet fitted into an as cast hole with a pressure.
Figure 3B:
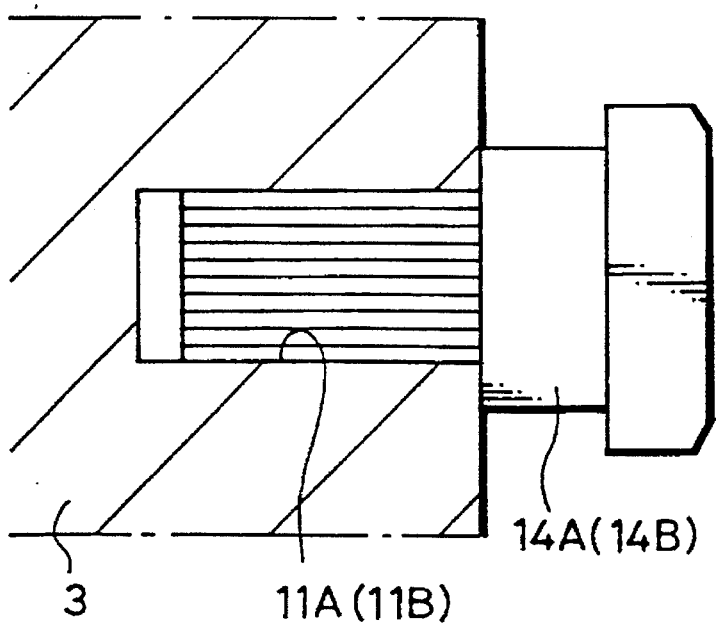
FIG. 3B is a diagram used to explain the state in which the engagement pin was fitted into the as cast hole with a pressure.

A pair of as cast holes, e.g., as cast holes 11 [11A, 11B] shown in FIGS. 3A, 3B are defined on the coupler 3 at its two positions, i.e., symmetrical positions. A pair of engagement pins 14 [14A, 14B] each having ridges 12 by knurling and a stepped head 13 are fitted into the as cast holes 11 [11A, 11B] with a pressure. The engagement pins 14 [14A, 14B] are made of Fe-based metal, for example.

The coupler 3 made by die-casting aluminum is treated by black-plating on its whole surface including the inside of the as cast holes 11 [11A, 11B]. When the engagement pins 14 are fitted into the as cast holes 11 with a pressure, the black film formed on the inside of the as cast holes 11 by the black-plating is removed, and hence the engagement pins 14 can be fixed into the as cast holes 11 more reliably.

An inner diameter $D_1$ of the as cast holes 11 [11A, 11B] is set to be smaller than an outer diameter $D_2$ of the engagement pins 14 [14A, 14B].

On the other hand, as shown in FIG. 2, there is provided an earth wire 16 comprising a covered wire $16_1$ and a bare wire $16_2$, and the covered wire $16_1$ is forked into two end portions **16*a*, 16*b*. The end portion 16*a* of the covered wire $16_1$ is in engagement with the engagement pin 14A, and the other end portion 16*b* is in engagement with the other engagement pin 14B through a spring 17. The earth wire 16 is connected to a chassis or the like. The bare wire $16_2$ is extended by the spring 17 and directly closely contacted with the outer carbon film 2, whereby the earth potential is applied to the outer carbon film 2**.

While a pair of engagement pins 14 [14A, 14B] are fixed into the coupler 3 with a pressure as described above, the present invention is not limited thereto, and the following variant is also possible. That is, as shown by a broken line 20 in FIG. 2, the as cast holes 11 [11A, 11B] may be defined on a pair of fixing members 6 at their symmetrical positions, and the engagement pins 14 [14A, 14B] may be fitted into and fixed into the as cast holes 11 [11A, 11B] with a pressure, whereby the earth wire 16 may be engaged with the engagement pins 14A, 14B through the similar spring 17.

The engagement pins 14 [14A, 14B] are fixed into the coupler 3 or the fixing members 6 with a pressure before assembly.

According to the above arrangement, since the as cast holes 11 [11A, 11B] are defined on the symmetrical positions of the coupler 3 or the fixing members 6 and the engagement pins 14 [14A, 14B] are fitted into the as cast holes 11 [11A, 11B] with a pressure, the engagement pins 14 [14A, 14B] can be reliably implanted with a satisfactory working property.

In addition, since the head 13 of the engagement pins 14 [14A, 14B] has a difference in level, the earth wire 16 can be easily reliably engaged with the engagement pins 14 [14A, 14B], and can be prevented from being detached from the engagement pins 14 [14A, 14B]. Furthermore, since the earth wire 16 is extended by the spring 17 to enable the bare wire $16_2$ to be directly closely contacted with the outer carbon film 2, the earth potential can be applied to the outer carbon film 2 by a simple arrangement.

As described above, according to the embodiment of the present invention, the earth potential can be easily reliably applied to the outer carbon film 2. Furthermore, since the working property can be improved considerably, a manufacturing cost of this kind of liquid cooling type cathode-ray tube can be lessened.

Having described a preferred embodiment of the invention with reference to the accompanying drawings, it is to be understood that the invention is not limited to that precise embodiment and that various changes and modifications could be effected therein by one skilled in the art without departing from the spirit or scope of the invention as defined in the appended claims.

What is claimed is:

1. In a liquid cooling type cathode-ray tube including a cathode-ray tube assembly, a coupler provided on a front surface of said cathode-ray tube assembly to seal a coolant and fixing members for fixing said coupler to said cathode-ray tube assembly, said liquid cooling type cathode-ray tube comprising:

a pair of holes defined on said coupler or said fixing members;

a pair of engagement pins fixed into said pair of holes with a pressure; and an earth wire which directly closely contacts with an outer conductive film to apply an earth potential to said outer conductive film, said earth wire being extended between said pair of engagement pins through a spring.

2. A liquid cooling type cathode-ray tube as claimed in claim 1, wherein said pair of holes are as cast holes.

3. A liquid cooling type cathode-ray tube as claimed in claim 2, wherein an inner diameter of said as cast holes is smaller than an outer diameter of said engagement pins.

4. A liquid cooling type cathode-ray tube as claimed in claim 3, wherein said coupler is molded of die-casting of aluminum.

5. A liquid cooling type cathode-ray tube as claimed in claim 4, wherein said outer conductive film is a carbon film.

6. In a method of fabricating a liquid cooling type cathode-ray tube including a cathode-ray tube assembly, a coupler provided on a front surface of said cathode-ray tube assembly to seal a coolant and fixing members for fixing said coupler to said cathode-ray tube assembly, said method of fabricating a liquid cooling type cathode-ray tube comprising the steps of:

defining a pair of holes on said coupler or said fixing members;

fixing a pair of engagement pins into said pair of holes with a pressure; and extending an earth wire, which directly closely contacts with an outer conductive film to apply an earth potential to said outer conductive film, between said pair of engagement pins through a spring.

7. A method of fabricating a liquid cooling type cathode-ray tube as claimed in claim 6, wherein said pair of holes are as cast holes.

8. A method of fabricating a liquid cooling type cathode-ray tube as claimed in claim 7, wherein an inner diameter of said as cast holes is smaller than an outer diameter of said engagement pins.

9. A method of fabricating a liquid cooling type cathode-ray tube as claimed in claim 8, wherein said coupler is molded of die-casting of aluminum.

10. A method of fabricating a liquid cooling type cathode-ray tube as claimed in claim 9, wherein said outer conductive film is a carbon film.

* * * * *